United States Patent [19]

Bianchi

[11] Patent Number: 4,724,553

[45] Date of Patent: Feb. 16, 1988

[54] APPARATUS TO CARRY OUT A CONTINUOUS WRAPPING HYDROMASSAGE OVER THE WHOLE BODY

[75] Inventor: Remigio Bianchi, Monza, Italy

[73] Assignee: Ecosystem S.r.l., Monza, Italy

[21] Appl. No.: 32,557

[22] Filed: Apr. 1, 1987

[30] Foreign Application Priority Data

Apr. 3, 1986 [IT] Italy ..... 19974 A/86

[51] Int. Cl.[4] ..... A47K 3/22

[52] U.S. Cl. ..... 4/615; 4/541; 4/601; 4/604; 128/66

[58] Field of Search ..... 4/615, 601, 597, 604, 4/605, 612, 613, 627, 661, 599, 541, 542, 543; 239/428.8, 429, 416.8, 416.4, 416, 587, 413; 128/66

[56] References Cited

U.S. PATENT DOCUMENTS

| | | | |
|---|---|---|---|
| 1,112,261 | 9/1914 | Carter | 4/615 X |
| 3,772,714 | 11/1973 | Sealby et al. | 4/541 |
| 4,220,145 | 9/1980 | Stamp et al. | 4/542 X |
| 4,339,833 | 7/1982 | Mandell | 4/541 X |
| 4,523,340 | 6/1985 | Watkins | 4/542 |
| 4,554,690 | 11/1985 | Knapp et al. | 4/601 |
| 4,679,258 | 7/1987 | Henkin et al. | 4/541 X |

FOREIGN PATENT DOCUMENTS

| | | | |
|---|---|---|---|
| 2341604 | 7/1973 | Fed. Rep. of Germany . | |
| 2432126 | 7/1974 | Fed. Rep. of Germany . | |
| 2524457 | 6/1975 | Fed. Rep. of Germany . | |
| 2536656 | 6/1984 | France | 4/615 |

*Primary Examiner*—Henry K. Artis
*Attorney, Agent, or Firm*—Robbins & Laramie

[57] ABSTRACT

In an apparatus for carrying out a continuous wrapping hydromassage over the whole body of a person only in one direction—of the type comprising, in a shower cabin, means rotating about an axis substantially coinciding with that of the body to be massaged, ejecting at least one water spout distributed according to a cylindrical helix having the same axis—said rotating means consist of a plurality of arc-shaped tube sections provided with nozzles ejecting a flat and divergent spout, said tube sections being supported in a horizontal or inclined position by a straight vertical tube feeding sid nozzles and being mounted and guided so as to rotate about said axis.

19 Claims, 8 Drawing Figures

APPARATUS TO CARRY OUT A CONTINUOUS WRAPPING HYDROMASSAGE OVER THE WHOLE BODY

BACKGROUND OF THE INVENTION

The benefits of massage on the human body are well known and it is also known that, in order to enjoy such benefits without having to resort to an expert masseur, it has recently become a diffused practice to undergo a hydromassage, this being a massage performed with liquid streams.

Nevertheless, up to a short time ago, hydromassages had been practiced with very scarce rationality in most of their applications; in fact, if performed in a liquid environment, the hydromassage reduced itself to lapping the body (or parts thereof) with scarcely efficacious liquid streams, distributed in a totally disorderly and uneven manner; whereas, if performed in an airy environment, it merely hit a limited part of the body with more or less violent, possibly intermittent, liquid jets. A rational distribution of the massaging action had in fact not been studied, nor had it been thought to direct said action according to the normal standards of massage. For a hydromassage to be efficacious, it should instead be complete and continuous, starting from the feet and moving up towards the head along the whole body, without any interruptions and with possibility to regulate the intensity and frequency of the liquid jets allowing to perform the hydromassage.

Solutions have recently been supplied, taking at least partly into account these fundamental requirements in facing the problems of hydromassage. Such solutions provide for apparatuses wherein means, rotating about an axis substantially coinciding with that of the body to be massaged, eject at least one water spout distributed according to a cylindrical helix having the same axis.

In practice, this type of apparatus has so far been obtained by means of very complicated structural systems, delicate in operation and/or limited in use only to parts of the human body.

In particular, the apparatus of the DE-A-2341604 provides for a structure holding a human body lying down, which comprises at least one rotating ring, moving longitudinally to the body, which ejects water spouts towards the inside of said structure. The complexity of the whole structure and the difficulties of a correct and reliable working of this apparatus appear quite evident, said apparatus being furthermore unsuited (unless resorting to even further structural complications) to perform a continuous and uninterrupted massage only in one direction, as it is indispensable for the body to obtain beneficial results.

The FR-A-2536656 describes in turn an apparatus of simpler mechanical characteristics and performing a more rational hydromassage, but which is however designed to operate over limited parts of the human body and which could not be used, such as it is conceived, for massaging the whole body of a person. In fact, this apparatus provides for a horizontal cage to hold one part of the body (for instance a leg), and the helical water spout hitting said part is ejected from a plurality of nozzles, obtained in a helically shaped tube rotating about its own axis, which coincides with the axis of the cage. The construction and steadiness in operation of the helical tube of this apparatus involve quite a lot of problems, deriving from the structure and mounting of the helical tube, which consists of a rotating member formed of strongly cantilevered portions. These problems become insurmountable as the tube grows in size, especially in length. It can thus be understood how the apparatus of the FR-A-2536656 cannot be used to perform a hydromassage on parts of the body extending beyond those shown in the drawings of this Patent and, even less, on the whole body of a person.

The aforementioned limitations of these apparatuses—which no doubt appear evident to an expert in the field—are probably the cause for the lack of diffusion thereof (they do not appear to be available on the market, nor to have been installed with some success in the past), but it should also objectively be said that such apparatuses have a specific destination, and that they can evidently be used only in nursing homes or hospitals, while being totally unsuited for installation in normal dwellings. This is instead becoming nowadays, an increasingly felt requirement: the fact of disposing in one's home of a simple and reliable apparatus, which takes up little room and allows, by merely replacing the normal shower, to perform in an easy and practical manner—and at a reasonable cost, both for what concerns installation and service—frequent hydromassages, tends to become a normal aspiration of people of a certain kind, when it is not actually imposed or recommended for health purposes.

It is anyhow certain that, in order to be able to adequately satisfy this requirement, it should be possible to easily install an apparatus for hydromassages in the bathroom of an apartment or of a hotel, in the manner of a shower, and it is indispensable for the apparatus to have most simple structural and functional characteristics, to be easily used and reliable, as well as being of reasonable cost. These characteristics—which cannot certainly be found, as seen, in the apparatuses of the previously cited patents—are instead all present in the apparatus object of the present invention which, after the hydromassage, is apt to perform also the sauna, thus completing in the most satisfactory manner a modern and efficacious health treatment of the body, which is certainly appreciated by a vast class of users.

SUMMARY OF THE INVENTION

The present invention therefore supplies an apparatus to carry out a continuous wrapping hydromassage over the whole body of a person only in one direction, of the type comprising, in a shower cabin, means rotating about an axis substantially coinciding with that of the body to be massaged, said means ejecting at least one water spout distributed according to a cylindrical helix having the same axis, characterized in that said rotating means consist of a plurality of arc-shaped tube sections provided with nozzles ejecting a flat and divergent spout, said tube sections being supported in a horizontal or inclined position by a straight vertical tube feeding said nozzles and being mounted and guided so at to rotate about said axis.

According to a first embodiment of the invention, said arc-shaped tube sections can be of equal length, supported in an inclined position by said straight vertical tube to which they are connected at different heights, in correspondence of their central part, and they comprise a plurality of evenly spaced nozzles ejecting flat and divergent spouts, inclined like said tube sections.

According to a second embodiment, the arc-shaped tube sections can instead be of different length, supported in a horizontal position by the straight vertical tube, to which they are connected at different heights with an end thereof, and they comprise, at their other end, a single nozzle ejecting an inclined, flat, divergent spout.

In either cases, the lengths of said tube sections, the heights at which they are connected to the straight vertical tube, and the inclinations of said tube sections and of the spouts, are chosen so that the nozzles may eject spouts forming a water stream according to a cylnidrical helix having its axis coinciding with that about which rotates the straight vertical tube.

The mounting and rotary motion of the straight vertical tube of the apparatus can be obtained in different ways. Said straight vertical tube preferably consists of the long portion of an L-shaped tube, the horizontal short portion of which is connected to a fixed feed pipe—at the centre of the cabin—by means of a watertight rotary joint. The straight, vertical, rotary tube is preferably guided, at least at one end and/or at intermediate points thereof, along its circular path. The connection between said rotary tube and the fixed pipe can be obtained both at the top and at the bottom of the cabin.

To allow carrying out, after the hydromassage, a drying treatment and/or a sauna, the apparatus according to the invention comprises—in the same shower cabin holding the unit formed of the feed pipe, of the straight vertical rotary tube and of the arc-shaped tube sections having nozzles ejecting water spouts—a heat exchanger for heating air with the water of the same circuit used for the hydromassage, and means for directing the air thus heated onto the body which has already been subjected to the hydromassage.

Preferably for the same purposes, the apparatus will also comprise a hot water storage reservoir, a humidity separator, and means to regulate the speed, temperature and humidity of the hot air being ejected.

BRIEF DESCRIPTION OF THE DRAWINGS

The invention will now be described in further detail, by mere way of non-limiting example, with reference to the accompanying drawings, which illustrate some embodiments thereof, and in which.

Figure 1:
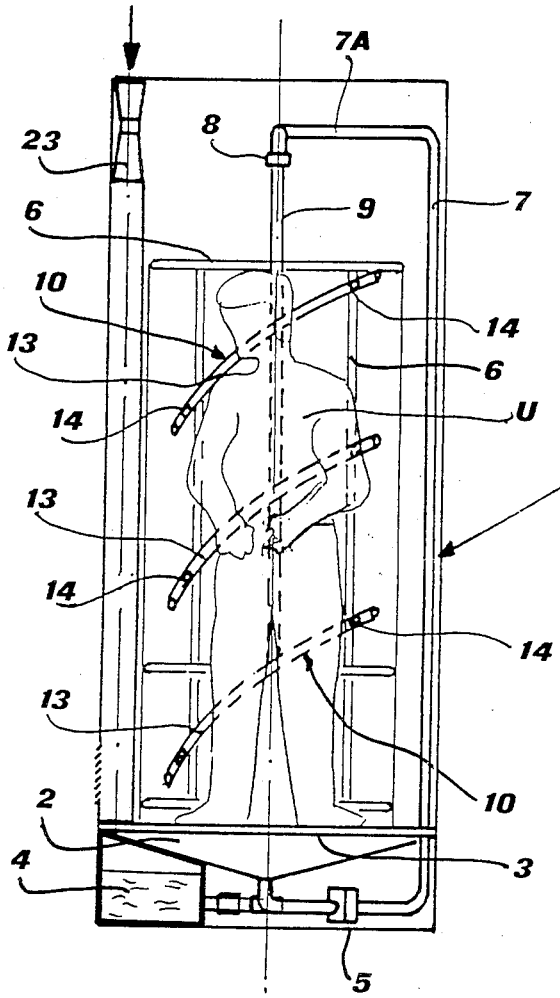
FIGS. 1 and 2 are diagrammatic elevation and, respectively, plane views of a first embodiment of the apparatus according to the invention, comprising three inclined arc-shaped tube section having a plurality of nozzles.

As shown in the drawings (particularly FIGS. 1 to 4), the apparatus according to the invention comprises a cabin 1 with square or circular structure, of the type of those used for normal showers, which is closed at the top by a roof and into which stands the user U.

The bottom of the cabin 1 contains a water recirculating reservoir, closed on the upper side by a grate 3 forming a discontinuous floor, onto which stands the user U and through which the ejected water automatically drops back into the reservoir 2, and hot water storage reservoir 4, to make the apparatus instantly available.

DESCRIPTION OF THE PREFERRED EMBODIMENTS

The lower part of the cabin 1 also contains a circulation pump 5 and other elements and fittings—as joints, valves and the like—of the water circuit.

The cabin 1 contains a cylindrical protection cage 6 (barely outlined in the drawings), formed of a plurality of horizontal concentric rings or bands and of vertical uprights, and having a door which opens to allow the passage of the user U.

Into the cabin, externally to said cage 6, there is arranged a fixed vertical pipe 7 fed with water, from the bottom, by the pump 5. The top of said pipe 7 is square bent in 7A to rotatably support at its free end 8—at the centre of the cabin and substantially in correspondence of the vertical axis of the person's body undergoing the hydromassage—the horizontal element of an L-shaped tube 9, to the longer straight vertical element of which there are applied arc-shaped tube sections 10, provided with nozzles ejecting a flat, divergent water spout.

Water is fed from the pipe 7 into the tube 9, through a watertight rotary joint positioned in 8, and from said tube 9 into the arc-shaped tube sections 10. The rotation of the tube 9—preferably produced, by reaction, through a tangential spout ejected by an auxiliary nozzle 11 provided on the short horizontal part of said tube 9—is positively guided along a circular path by guides 12 (see FIGS. 3 and 4), provided at the bottom and/or on the roof of the cabin 1, and/or fixed at any height of the protection cage 6.

Figure 2:
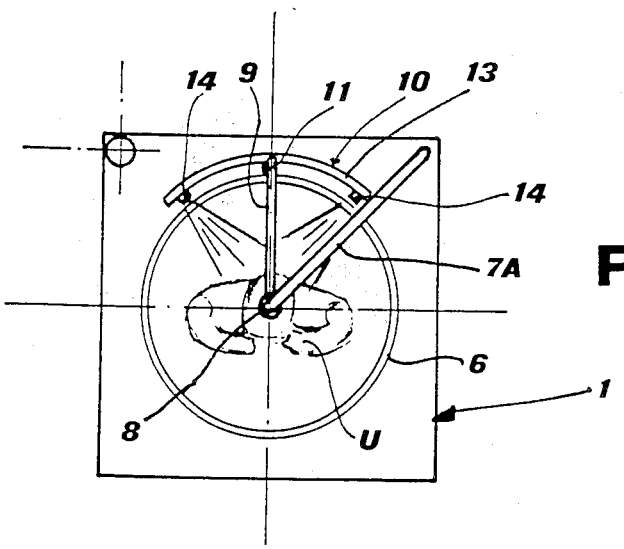

In the embodiment of FIGS. 1 and 2, the arc-shaped tube sections 10 consist of three tubular elements 13 of equal length, supported in an inclined position by the straight vertical rotary tube 9 which feed them with water. The elements 13 are connected to the tube 9 at different, evenly spaced heights, in correspondence of their central portion, and they each comprise a plurality of equally spaced nozzles 14, ejecting flat divergent spouts, inclined like said elements 13. Such elements are furthermore adjacent, in the sense that the ends thereof are spaced apart, but substantially on the same level. The arrangement is such that, when water is fed to the pipe 7 by the pump 5 and it is ejected from the nozzles 11 and 14, the body of the person standing in the cabin is hit by spouts distributed in the manner of a cylindrical helix, which form a stream of whirling water, said stream performing—according to the chosen direction of rotation—a continuous hydromassage over the whole body, from foot to head.

Figure 3:
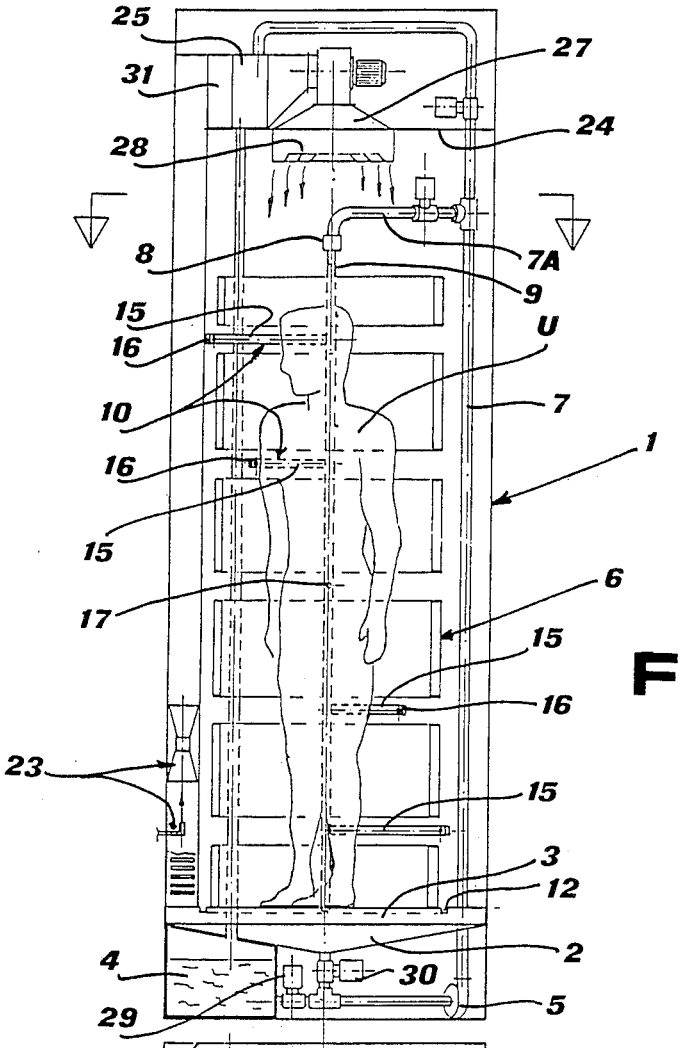
FIGS. 3 and 4 are views similar to those of FIGS. 1 and 2, of a second embodiment of the apparatus according to the invention, comprising four horizontal arc-shaped tube sections having a single nozzle.
Figure 4:
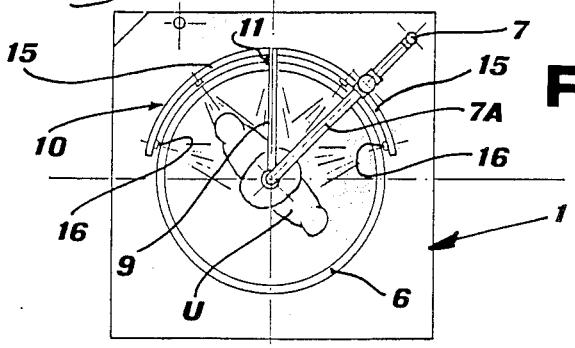
Figure 5:
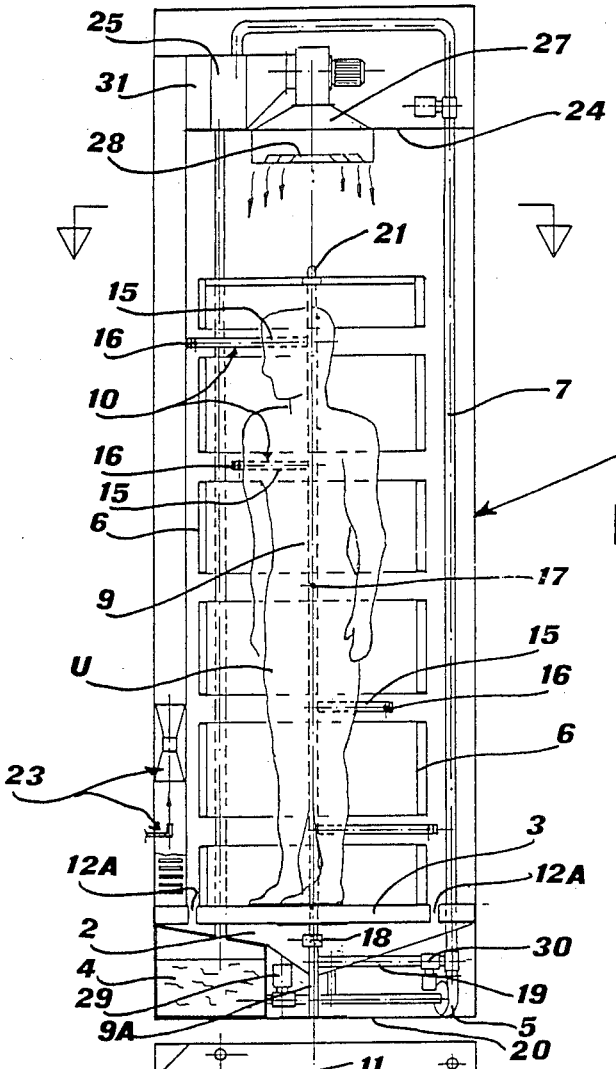
FIGS. 5 and 6 and, respectively, 7 and 8, show two modifications of the embodiment of the invention illustrated in FIGS. 3 and 4.
Figure 6:
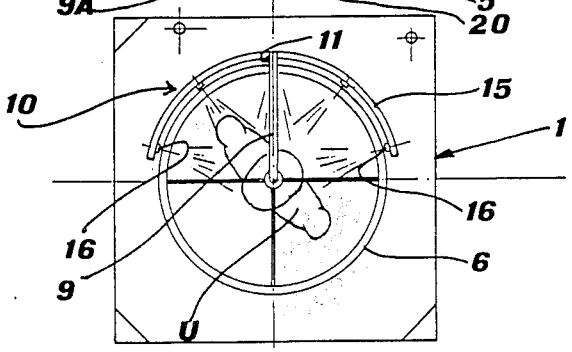

The same object can be reached with the embodiment of the invention shown in FIGS. 3 and 4. In this case, the tube sections 10 consist of four tubular elements 15 of different lengths, supported in a horizontal position by the straight vertical tube 9, to which they are connected by an end at different, evenly spaced heights. Each element 15 has a single nozzle 16, positioned at the free end thereof, to eject a suitably inclined, flat, divergent spout. The length and mutual spacing of the elements 15 is such that their ends are arranged on a cylindrical helix with axis coinciding with the rotation axis of the straight vertical tube 9. In particular, in the embodiment shown in FIGS. 3 and 4, the elements 15 positioned at the top and at the bottom are longer (preferably, about one quarter of a circle), while the intermediate elements are shorter (preferably, about half the length of the longer elements). The distance between the shorter elements 15 is twice that provided between these elements and the longer elements 15, a nozzle 17 being positioned half way between said shorter elements 15, directly on the vertical tube 9.

Thanks to this arrangement and to the appropriate inclination of the nozzles 16 and 17 according to said cylindrical helix, when the L-shaped tube 9 is caused to rotate—preferably by reaction, thanks to the tangentially directed auxiliary nozzle 11 provided for the purpose on the tube 9—the user is hit by a stream of whirling water forming a cylindrical helix.

Various modifications can be made to the embodiment of FIGS. 3 and 4: for instance, the straight rotary vertical tube 9 can be pivotally connected at the bottom as well as at the top of the pipe 7, so as to favour a better guidance thereof.

Figure 7:
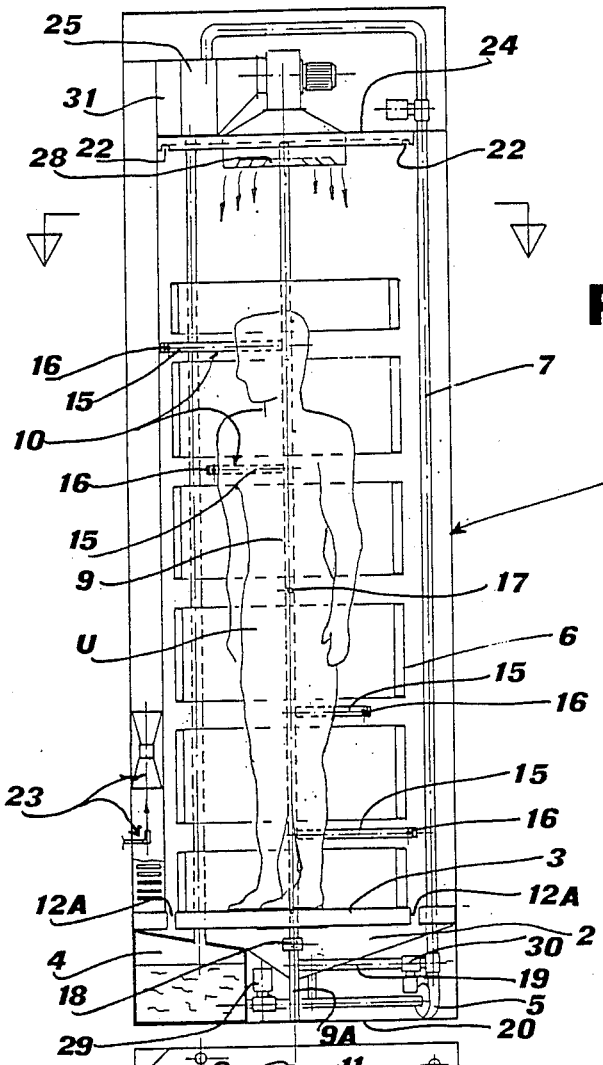
Figure 8:
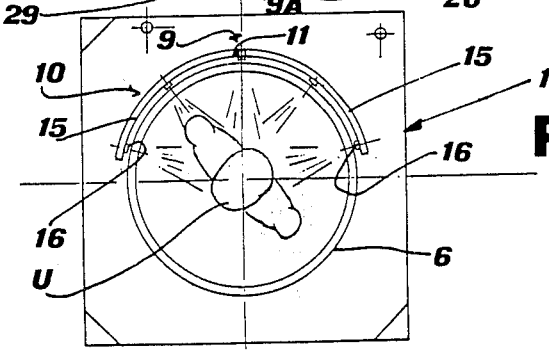

In the embodiments shown in FIGS. 5 to 8, said tube 9 (instead of being fed from the top by the pipe 7) is fed from the bottom—through a lower horizontal portion thereof and thanks to a watertight rotary joint 18—by a fixed pipe 19 fed by the pump 5. In this case the grate 3, onto which stands the user, remains isolated thanks to the presence of a continuous circular slit 12A allowing the circular motion of the tube 9, and must therefore be supported by said tube 9, this latter being provided, for the purpose, with a vertical projection 9A, extending down to the surface 20 onto which bears the whole apparatus. For what concerns the top part of the rotary tube 9, it can still be L-shaped and have its end pivotally connected, in 21, to the centre of the cabin roof (FIGS. 5 and 6), or else it can end into a straight portion and be caused to slide into a circular guide 22 of said roof (FIGS. 7 and 8).

The force of the spout ejected by the nozzles 14 and 16, of the apparatus according to the invention, can be regulated by varying the pressure of the water being fed. It is moreover possible to exclude part of said nozzles, for instance the top ones, through an appropriate cover.

The cabin comprises suction means for removing the steam and interchanging the air, said means consisting of a cold water injector with Venturi tube 23, and being mounted laterally (at the top in the embodiment of FIGS. 1 and 2, at the bottom in the other embodiments) inside the cabin 1.

A mechanical device (not shown) can also be provided, to stop the straight rotary vertical tube 9 in correspondence of the fixed part of the cage 6, so as to allow the user to freely pass through the cage door. Furthermore, means (not shown) can be arranged inside or outside the cabin, to introduce liquids or powders for nebulization, washing and disinfection.

As already mentioned, according to the present invention, the heretofore described and illustrated apparatus allows to carry out—in addition to a continuous wrapping hydromassage, almost simultaneously over the whole body, from foot to head—also a drying treatment followed by a sauna, by blowing onto the user's body a strong current of dry air at high temperature, which can be regulated at will.

For this purpose, it is sufficient—as shown in FIGS. 3 to 8—to supply the cabin 1 with an upper cover 24 limiting its volume, with a heat exchanger 25 fed with hot water circulated by the same pump 5 which feeds the tubes and nozzles for the hydromassage, said water being at least partly drawn from the storage reservoir 4, and with a fan 27 blowing the hot air, through a nozzle 28 positioned at the centre of the cover 24, onto the body of the user U. Solenoid valves 29 and 30 control the hot water circuit (in which the storage reservoir 4, heated by heating elements controlled by a thermostat, performs the function of a lung, keeping the water held therein always at a temperature higher than the feeding temperature), while the hot air circuit completes its return path through the Venturi tube 23 and comprises a separator 31 for drops. Means are moreover provided (not shown) to control—as well as the temperature and possibly the humidity of the air—also the speed at which it is blown from the nozzle 28 and its direction, so as to prevent it from blowing directly onto delicate body parts, especially on the head.

Automatic sequences can be proveded for operating the apparatus, which may alternatively be controlled directly by the user, with all the necessary protective measures.

From the detailed description of the apparatus according to the invention, it appears evident how the same allows to carry out a treatment of hydromassage and sauna on the human body, in a very simple and practical manner, and very valid from the point of view of health and hygiene. The hydromassage is performed—according to the normal standards followed for this type of treatment—continuously from foot to head, thanks to the uninterrupted stream of whirling water, forming a cylindrical helix, which hits the body. Said stream is on the other hand obtained by mechanical means, which are of simple construction, safe operation, positively reliable also in case of prolonged use, and of very easy maintenance. Also the costs are limited, since the structure of the apparatus requires—in spite of its performances, which are no doubt better than those offered by the far more complicated apparatuses of known technique—standardized elements and fittings, often of elementary shapes and easy to be mutually connected for assembly.

I claim:

1. Apparatus to carry out a continuous wrapping hydromassage over the whole body of a person only in one direction, of the type comprising, in a shower cabin, means rotating about an axis substantially coinciding with that of the body to be massaged, said means ejecting at least one water spout distributed according to a cylindrical helix having the same axis, characterized in that said rotating means consist of a plurality of arc-shaped tube sections provided with nozzles ejecting a flat and divergent spout, said tube sections being supported in a horizontal or inclined position by a straight vertical tube feeding said nozzles and being mounted and guided so as to rotate about said axis.

2. Apparatus as in claim 1, wherein said arc-shaped tube sections are of equal length, supported in an inclined position by said straight vertical tube to which they are connected at different heights in correspondence of their central part, and they comprise a plurality of evenly spaced nozzles ejecting flat and divergent spouts, inclined like said tube sections.

3. Apparatus as in claim 2, comprising three of said arc-shaped tube sections.

4. Apparatus as in claim 1, wherein said arc-shaped tube sections are of different length, supported in a horizontal position by said straight vertical tube to which they are connected at different heights with an end thereof, and they comprise, at their other end, a single nozzle ejecting an inclined, flat, divergent spout.

5. Apparatus as in claim 4, wherein the length and mutual spacing of said arc-shaped tube sections are such that their ends are arranged on a cylindrical helix with axis coinciding with the rotation axis of the straight vertical tube.

6. Apparatus as in claim 5, comprising four of said arc-shaped tube sections.

7. Apparatus as in claim 6, wherein two of said arc-shaped tube sections extend through one quarter of a circle, and the other two extend through about half of said length, the first two longer sections being mounted at the top and, respectively, at the bottom, while the other two are mounted in an intermediate positon, the distance between these two intermediate sections being twice that provided between each intermediate section and the corresponding top or bottom section, and the straight vertical tube to which said sections are connected comprising a nozzle half way between the two intermediate arc-shaped tube sections.

8. Apparatus as in claim 1, wherein said straight vertical rotary tube is the long portion of an L-shaped tube, the short horizontal portion of which is connected, at the centre of the cabin, by means of a watertight rotary joint, to a fixed feed pipe.

9. Apparatus as in claim 8, wherein the connection between said straight vertical rotary tube and the fixed feed pip is obtained in correspondence of the central top part of the cabin.

10. Apparatus as in claim 8, wherein the connection between said straight vertical rotary tube and the fixed feed pipe is obtained in correspondence of the central bottom part of the cabin.

11. Apparatus as in claim 1, wherein said straight vertical rotary tube is guided, at least at one end and/or at intermediate points thereof, along its circular path.

12. Apparatus as in claim 1, wherein the rotation of said straight vertical tube is obtained by reaction, thanks to an auxiliary nozzle ejecting a tangential spout.

13. Apparatus as in claim 1, wherein a protective cage structure, comprising an access door, is interposed between the body to be massaged and the means ejecting the water spout forming a cylindrical helix.

14. Apparatus as in claim 13, wherein means are provided to stop the rotation of the straight vertical tube, positioned externally to said door of access to the protection cage.

15. Apparatus as in claim 1, comprising more than one plurality of arc-shaped tube sections, with respective straight vertical rotary support tube.

16. Apparatus as in claim 1, comprising means to regulate the force of the spouts ejected from the nozzles.

17. Apparatus as in claim 1, comprising—in the same shower cabin holding the unit formed of the feed pipe, of the straight vertical rotary tube and of the arc-shaped tube sections having nozzles ejecting water spouts—a heat exchanger for heating air with the water of the same circuit used for the hydromassage, and means for directing the air thus heated onto the body standing in the cabin.

18. Apparatus as in claim 17, comprising furthermore a hot water storage reservoir, a humidity separator, air interchange means, and means to regulate the speed, temperature and humidity of the hot air.

19. Apparatus as in claim 1, wherein the air interchange means comprise a cold water injector and a Venturi tube.

* * * * *